US011387534B2

(12) United States Patent
Ueda et al.

(10) Patent No.: US 11,387,534 B2
(45) Date of Patent: Jul. 12, 2022

(54) CONVERTER AND ANTENNA DEVICE

(71) Applicant: MITSUBISHI ELECTRIC CORPORATION, Tokyo (JP)

(72) Inventors: Ryo Ueda, Tokyo (JP); Yu Ushijima, Tokyo (JP); Hidenori Ishibashi, Tokyo (JP); Takashi Maruyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 167 days.

(21) Appl. No.: 16/927,041

(22) Filed: Jul. 13, 2020

(65) Prior Publication Data

US 2020/0343613 A1 Oct. 29, 2020

Related U.S. Application Data

(63) Continuation of application No. PCT/JP2018/027973, filed on Jul. 25, 2018.

(30) Foreign Application Priority Data

Jan. 19, 2018 (WO) ..... PCT/JP2018/001559

(51) Int. Cl.

| | |
|---|---|
| ***H01Q 1/50*** | (2006.01) |
| ***H01Q 13/00*** | (2006.01) |
| ***H01P 5/10*** | (2006.01) |
| ***H01P 5/08*** | (2006.01) |
| ***H01P 3/08*** | (2006.01) |
| ***H01P 3/12*** | (2006.01) |

(52) U.S. Cl.

CPC ..... *H01P 5/08* (2013.01); *H01P 3/081* (2013.01); *H01P 3/121* (2013.01); *H01Q 1/50* (2013.01)

(58) Field of Classification Search

CPC .... H01P 3/081; H01P 3/08; H01P 3/12; H01P 3/121; H01P 5/08; H01P 5/10; H01P 5/107; H01Q 1/50; H01Q 13/00; H01Q 13/02; H01Q 13/18; H01Q 21/00

See application file for complete search history.

(56) References Cited

U.S. PATENT DOCUMENTS 7,498,896 B2 * 3/2009 Shi ..... H01P 5/107 333/33
8,604,991 B2 * 12/2013 Nagayama ..... H01Q 21/064 343/774
8,723,616 B2 * 5/2014 Hirota ..... H01P 5/107 333/125

(Continued)

FOREIGN PATENT DOCUMENTS

CN 106549203 A 3/2017
JP 2017-85420 A 5/2017

OTHER PUBLICATIONS

Seo, et al., "Via-Hole-Less Planar Microstrip-to-Waveguide Transition in Millimeter-Wave Band", Proc. CJMW2011, 12031106, May 2011, Total 4 pages.

(Continued)

*Primary Examiner* — Tho G Phan

(74) *Attorney, Agent, or Firm* — Birch, Stewart, Kolasch & Birch, LLP

(57) ABSTRACT

A converter includes an electrical opening which is a loop pattern, at one end of a conductor pattern located immediately above one end of a waveguide with a dielectric substrate interposed therebetween.

15 Claims, 7 Drawing Sheets

(56) References Cited

U.S. PATENT DOCUMENTS

| | | | | |
|---|---|---|---|---|
| 9,105,953 | B2 * | 8/2015 | Gomi | H01P 5/107 |
| 10,090,598 | B2 * | 10/2018 | Uemichi | H01Q 13/18 |
| 10,811,753 | B2 * | 10/2020 | Nakajima | H01P 3/121 |
| 2004/0041651 | A1 | 3/2004 | Shono | |
| 2021/0288391 | A1 * | 9/2021 | Maruyama | H01P 5/028 |

OTHER PUBLICATIONS

German Office Action for German Application No. 112018006410.7, dated Feb. 25, 2022, with an English translation.

* cited by examiner

CONVERTER AND ANTENNA DEVICE

CROSS REFERENCE TO RELATED APPLICATIONS

This application is a Continuation of PCT International Application No. PCT/JP2018/027973, filed on Jul. 25, 2018 which claims priority under 35 U.S.C. 119(a) to Patent Application No. PCT/JP2018/001559, filed in Japan on Jan. 19, 2018, all of which are hereby expressly incorporated by reference into the present application.

TECHNICAL FIELD

The present invention relates to a converter that performs conversion between a signal propagated in a waveguide and a signal propagated in a planar circuit, and an antenna device including the converter.

BACKGROUND ART

Known in the related art are converters that perform conversion between a signal propagated in a waveguide and a signal propagated in a planar circuit. For example, a converter in which a waveguide and a microstripline are coupled propagates a signal from the waveguide to the microstripline, or propagates a signal from the microstripline to the waveguide. Such a converter is widely used in an antenna device that transmits a high frequency signal in a microwave band or a millimeter wave band.

For example, Patent Literature 1 describes a converter including a waveguide and a multilayer substrate including a dielectric substrate and a conductor substrate. A ground plate is provided on a surface of the multilayer substrate to which the waveguide is coupled, and a conductor pattern is formed on the surface opposite to the ground plate. A part of the ground plate is opened, and a loop conductor pattern is formed on an inner layer of the multilayer substrate so as to surround the opening. By setting the width of the loop conductor pattern to a width that is an odd multiple of a quarter wavelength of the guide wavelength from an end of the opening, the loop conductor pattern functions as a choke that prevents leakage of radio waves.

A converter of the related art generally prevents leakage of radio waves by forming a large number of through-holes that electrically couple a conductor pattern provided on the front surface of a dielectric substrate and a ground conductor provided on the back surface of the dielectric substrate. Meanwhile, in the converter described in Patent Literature 1, it is possible to prevent leakage of radio waves, without forming through-holes, by forming a loop conductor pattern that functions as a choke.

CITATION LIST

Patent Literature

Patent Literature 1: JP 2017-85420 A

SUMMARY OF INVENTION

Technical Problem

In the converter described in Patent Literature 1, there is a disadvantage that miniaturization is limited since the conductor pattern, having a width set to an odd multiple of a quarter wavelength of the guide wavelength from an end of the opening, is formed so as to surround the opening of the ground plate.

Moreover, in the converter described in Patent Literature 1, when the loop conductor pattern is removed in favor of miniaturization, a conductor pattern remain which has a length of a quarter wavelength of the guide wavelength from immediately above the waveguide. Since this conductor pattern has an open end, unwanted radio waves are emitted from the open end.

This invention solves the above disadvantages, and it is an object of the invention to obtain a converter which is miniaturized and can suppress unwanted emission of radio waves and obtain an antenna device including the converter.

Solution to Problem

A converter according to the present invention includes a waveguide, a dielectric substrate, a conductor pattern, a ground conductor, and one or more slots. The dielectric substrate is coupled with one end of the waveguide on a back surface of the dielectric substrate. The conductor pattern is provided on a front surface of the dielectric substrate and has a signal input/output terminal at one end of the conductor pattern and an electrical opening that is electrically open at another end of the conductor pattern. The ground conductor is provided on the back surface of the dielectric substrate. The slots are formed in an area covered with the one end of the waveguide in the ground conductor. In this configuration, a part of the conductor pattern is located immediately above the one end of the waveguide, the dielectric substrate being interposed between the part of the conductor pattern and the one end of the waveguide, and the electrical opening is a loop pattern.

Advantageous Effects of Invention

According to the present invention including the electrical opening being a loop pattern at one end of the conductor pattern located immediately above the one end of the waveguide with the dielectric substrate interposed therebetween, there is no need to provide the choke structure described in Patent Literature 1 and thus it is possible to implement a smaller converter. Furthermore, since the electrical opening is the loop pattern, it is possible to prevent leakage of radio waves even without a choke. This enables miniaturization and suppression of unwanted emission of radio waves.

DESCRIPTION OF EMBODIMENTS

To describe the present invention further in detail, embodiments for carrying out the invention will be described below with reference to the accompanying drawings.

First Embodiment

Figure 1:
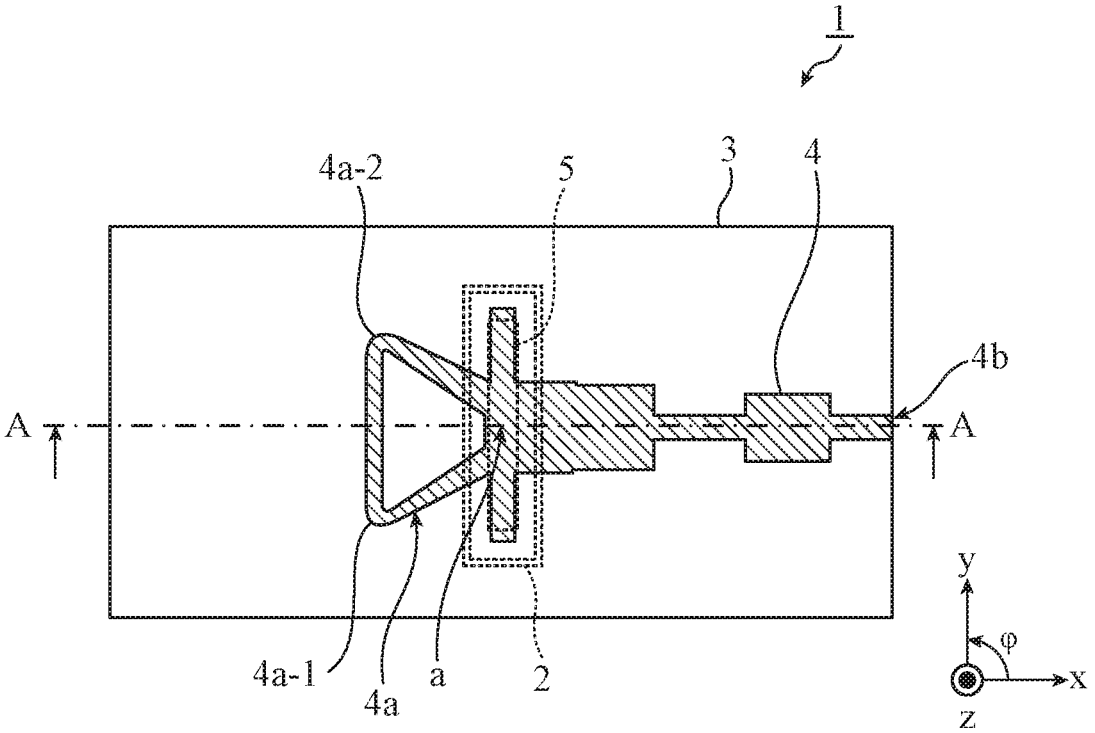
FIG. 1 is a top view illustrating a configuration of a converter according to a first embodiment of the invention.
Figure 2:
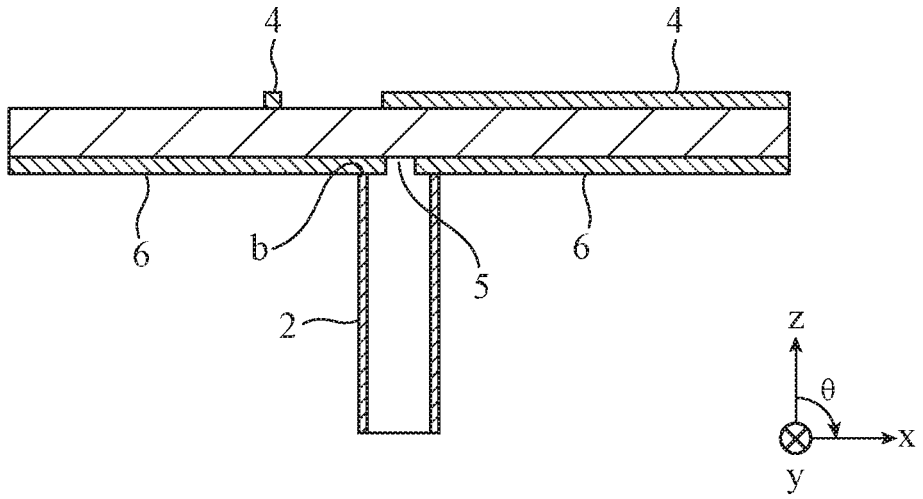
FIG. 2 is a cross-sectional arrow view illustrating a cross section of the converter according to the first embodiment taken along line A-A in FIG. 1.

FIG. 1 is a top view illustrating a configuration of a converter 1 according to a first embodiment of the invention. FIG. 2 is a cross-sectional arrow view illustrating a cross section of the converter 1 taken along line A-A in FIG. 1. The x axis, y axis, and z axis illustrated in the drawings are three axes orthogonal to each other. A direction parallel to the x axis is referred to as an x axis direction, a direction parallel to the y axis is referred to as a y axis direction, and a direction parallel to the z axis is referred to as an z axis direction. In an x axis direction, a direction in the arrow is referred to as a positive x direction, and a direction opposite to the positive x direction is referred to as a negative x direction. In a y axis direction, a direction in the arrow is referred to as a positive y direction, and a direction opposite to the positive y direction is referred to as a negative y direction. In a z axis direction, a direction in the arrow is referred to as a positive z direction, and a direction opposite to the positive z direction is referred to as a negative z direction. A rotation angle on the xy plane from the x axis to the y axis around the z axis is denoted as $\Phi$, and a rotation angle on the zx plane from the z axis to the x axis around the y axis is denoted as $\theta$.

The converter 1 performs conversion between a signal propagated in a waveguide 2 and a signal propagated in a planar circuit including a conductor pattern 4. As illustrated in FIG. 1 and FIG. 2, the converter 1 includes the waveguide 2, a dielectric substrate 3, the conductor pattern 4, a slot 5, and a ground conductor 6.

The waveguide 2 is a hollow waveguide having one end coupled to the dielectric substrate 3. In the dielectric substrate 3, the waveguide 2 is coupled to the back surface, and the conductor pattern 4 is formed on the front surface. The dielectric substrate 3 is a flat plate member made of a resin material. The dielectric substrate 3 may be a single-layer substrate, but may be a multilayer dielectric substrate in which a plurality of dielectric substrates and a conductor substrate are laminated.

The conductor pattern 4 is a belt-like pattern in which an input/output terminal **4*b* is provided at one end and an electrical opening 4*a* is provided at the other end. The conductor pattern 4 is formed, for example, by pressure-bonding a conductive metal foil (such as a copper foil) to the front surface of the dielectric substrate 3 and thereby patterning the metal foil. The conductor pattern 4 may be formed by attaching a patterned metal plate to the front surface of the dielectric substrate 3. A signal is input to/output from the input/output terminal 4*b*. The electrical opening 4*a*** is a loop conductor pattern and is electrically open.

A part of the conductor pattern 4 is located immediately above the one end of the waveguide 2 with the dielectric substrate 3 interposed therebetween as illustrated in FIG. 1. On the back surface of the dielectric substrate 3, the ground conductor 6 is formed on the entire surface as illustrated in FIG. 2. The slot 5 is formed in an area covered with the one end of the waveguide 2 in the ground conductor 6.

A part of the conductor pattern 4 is located immediately above the slot 5 with the dielectric substrate 3 interposed therebetween.

Note that in FIG. 1 and FIG. 2, the conductor pattern 4 provided on the front surface of the dielectric substrate 3 forms a microstripline together with the ground conductor 6. However, the conductor pattern 4 may form, together with the ground conductor 6, any of a strip line, a coplanar line, or a coplanar line attached with a ground conductor.

Figure 3:
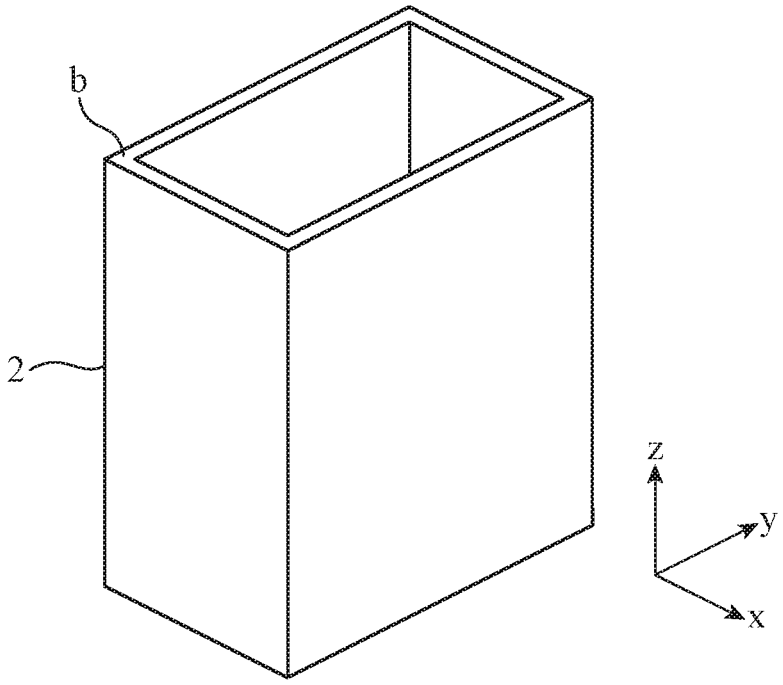
FIG. 3 is a perspective view illustrating a waveguide in the first embodiment.

FIG. 3 is a perspective view illustrating the waveguide 2. As illustrated in FIG. 3, the waveguide 2 is a hollow metal tube having metal tube walls. An xy cross section of the waveguide 2 is a rectangle having a long side parallel to they axis and a short side parallel to the x axis as indicated by a broken line in FIG. 1. The waveguide 2 is joined to the ground conductor 6 at an opening edge b illustrated in FIG. 2, and is electrically short-circuited.

Note that the waveguide 2 may have any configuration. For example, the waveguide 2 may be a tube filled with a dielectric. The waveguide 2 may be a tube having a tube wall in which a plurality of through-holes is formed instead of a metal tube wall, the tube being filled with a dielectric. The waveguide 2 may have a shape in which the corners of a rectangular that is an xy cross section have a curvature, or may be a ridge type waveguide.

The position where the electrical opening **4*a* is formed is away from a position a immediately above the waveguide 2 with the dielectric substrate 3 interposed therebetween, in the negative x direction by 0 times or an integral multiple greater than or equal to 1 of a half wavelength of a guide wavelength. Note that the position a is immediately above the center of the opening of the waveguide 2 with the dielectric substrate 3 interposed therebetween. In the example of FIG. 1, the electrical opening 4*a* is formed from a position away from the position a immediately above the waveguide 2 with the dielectric substrate 3 interposed therebetween in the negative x direction (on the opposite side of the input/output terminal 4*b*) by 0 times a half wavelength of the guide wavelength, that is, the electrical opening 4*a*** is formed from the position a.

The electrical opening **4*a* is a loop pattern having the total perimeter length obtained by multiplying a half wavelength of the guide wavelength by a natural number greater than or equal to 1. Since the electrical opening 4*a*** is a loop pattern and there is no opening at the end, it is possible to suppress emission of unwanted radio waves.

In the converter described in Patent Literature 1, in order to suppress leakage of unwanted radio waves without forming a large number of through-holes, the loop conductor pattern having a width set to an odd multiple of a quarter wavelength of the guide wavelength is provided from an end of the slot, as a choke.

Meanwhile, in the converter 1 according to the first embodiment, a loop conductor pattern that functions as a choke is unnecessary because the electrical opening 4*a* is included. For example, the conductor pattern 4 does not include a portion surrounding the slot 5, and thus the dimension in the y axis direction is reduced as compared with the converter described in Patent Literature 1. As a result, the converter 1 can be miniaturized as compared with converters of the related art as described above.

In the example of FIG. 1, the electrical opening 4*a* is an equilateral triangular loop pattern having a bended portion 4*a*-1 and a bended portion 4*a*-2. The triangle has a loop shape whose total perimeter is three halves of the guide wavelength, in other words, one side has a length of a half wavelength of the guide wavelength. The bended portion 4*a*-1 and the bended portion 4*a*-2 are formed by bending the conductor pattern at positions each having a length of a half wavelength of the guide wavelength. As a result, each of the bended portion 4*a*-1 and the bended portion 4*a*-2 is a node of the electric field and in principle has no energy, and thus unwanted emission of radio waves is unlikely to occur.

Note that the electrical opening 4*a* which is a triangular loop pattern is merely an example, and may be a polygonal loop pattern of any polygon having four or more sides or a smooth curved loop pattern.

Note that although a part of the pattern width of the electrical opening 4*a* has a so-called tapered shape in FIG. 1 in which the pattern width decreases from the position a toward the bended portions 4*a*-1 and 4*a*-2, the pattern width of the electrical opening 4*a* may be in any manner.

Figure 4:
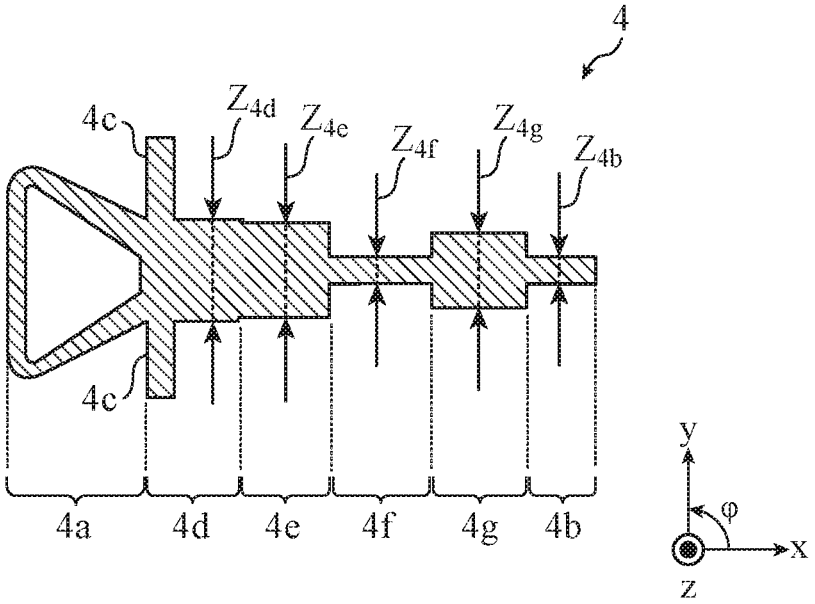
FIG. 4 is a plan view illustrating a conductor pattern in the first embodiment.

FIG. 4 is a plan view illustrating the conductor pattern 4. As illustrated in FIG. 4, the conductor pattern 4 includes stubs 4*c*, a conversion portion 4*d*, and impedance transforming portions 4*e* to 4*g* in addition to the electrical opening 4*a* and the input/output terminal 4*b*. The stubs 4*c* and the impedance transforming portions 4*e* to 4*g* function as a matching element that adjusts the impedance of the conversion portion 4*d* and the impedance of the waveguide 2, that is, as a matching element that performs reflection matching.

The stubs 4*c* are a conductor pattern extending in the positive y direction of the conversion portion 4*d* and a conductor pattern extending in the negative y direction of the conversion portion 4*d*, and are provided immediately above the slot 5 with the dielectric substrate 3 interposed therebetween as illustrated in FIG. 1. The length of each of the stubs 4*c* that extend linearly from the conversion portion 4*d* in the positive y direction and the negative y direction corresponds to the length of a quarter wavelength of the guide wavelength. Note that the end of each of the stubs 4*c* is open.

The conversion portion 4*d* and the impedance transforming portions 4*e* to 4*g* each have a characteristic impedance corresponding to the pattern width thereof. The conversion portion 4*d* has a characteristic impedance $Z_{4d}$ corresponding to the pattern width, and the impedance transforming portion 4*e* has a characteristic impedance $Z_{4e}$ corresponding to the pattern width. The impedance transforming portion 4*f* has a characteristic impedance $Z_{4f}$ corresponding to the pattern width, and the impedance transforming portion 4*g* has a characteristic impedance $Z_{4g}$ corresponding to the pattern width. The input/output terminal 4*b* has a characteristic impedance $Z_{4b}$ corresponding to the pattern width.

If the input/output terminal 4*b* and the conversion portion 4*d* are formed next to each other, unwanted emission of radio waves increases due to mismatch between the characteristic impedance $Z_{4b}$ of the input/output terminal 4*b* and the characteristic impedance $Z_{4d}$ of the conversion portion 4*d*, thereby increasing the power loss. Therefore, in the conductor pattern 4 in the first embodiment, the impedance transforming portions 4*e* to 4*g* perform impedance matching between the conversion portion 4*d* and the input/output terminal 4*b*.

The characteristic impedance $Z_{4e}$ of the impedance transforming portion 4*e* is smaller than the characteristic impedance $Z_{4b}$ of the input/output terminal 4*b* and larger than the characteristic impedance $Z_{4d}$ of the conversion portion 4*d*. That is, a relationship of $Z_{4d}<Z_{4e}<Z_{4b}$ holds.

The characteristic impedance $Z_{4f}$ of the impedance transforming portion 4*f* is equal to the characteristic impedance $Z_{4b}$ of the input/output terminal 4*b* and larger than the characteristic impedance $Z_{4e}$ of the impedance transforming portion 4*e*, and thus a relationship of $Z_{4e}<Z_{4f}=Z_{4b}$ holds.

The characteristic impedance $Z_{4g}$ of the impedance transforming portion 4*g* is smaller than each of the characteristic impedance $Z_{4f}$ of the impedance transforming portion 4*f* and the characteristic impedance $Z_{4b}$ of the input/output terminal 4*b* and larger than the characteristic impedance $Z_{4e}$ of the impedance transforming portion 4*e*. A relationship of $Z_{4e}<Z_{4g}<Z_{4f}=Z_{4b}$ holds.

The converter 1 according to the first embodiment includes the impedance transforming portion 4*e* and the impedance transforming portion 4*g* having pattern widths larger than that of the input/output terminal 4*b*. With this configuration, impedance matching is performed between the conversion portion 4*d* and the input/output terminal 4*b*, thereby reducing the power loss. Note that the stubs 4*c*, the conversion portion 4*d*, and the impedance transforming portions 4*e* to 4*g* illustrated in FIG. 4 are examples, and the number of stubs 4*c* and the number of stages of the impedance transforming portions are modified depending on reflection matching conditions.

Figure 5:
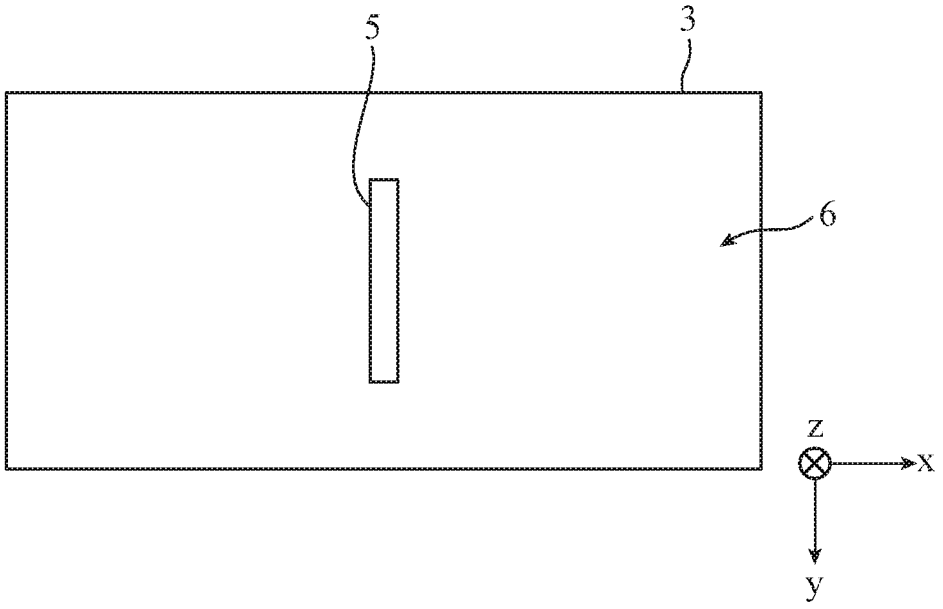
FIG. 5 is a plan view illustrating a ground conductor having a rectangular slot in the first embodiment.

FIG. 5 is a plan view illustrating the ground conductor 6 including the slot 5 having a rectangular shape. The slot 5 is formed in an area covered with the one end of the waveguide 2 in the ground conductor 6, that is, the area surrounded by the opening edge b. The case is illustrated in FIG. 1 to FIG. 5 in which only one slot 5 is formed in the area surrounded by the opening edge b; however, a plurality of slots 5 maybe formed in the area surrounded by the opening edge b. The ground conductor 6 is formed by pressure-bonding a conductive metal foil (such as a copper foil) to the back surface of the dielectric substrate 3. The ground conductor 6 may be formed by attaching a metal plate to the back surface of the dielectric substrate 3.

Figure 6:
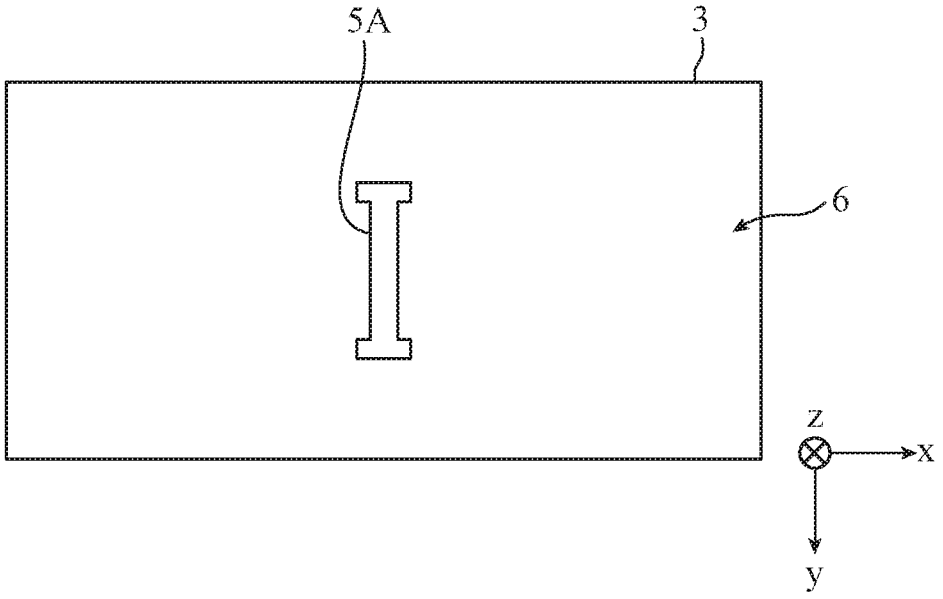
FIG. 6 is a plan view illustrating a ground conductor having an H-shaped slot in the first embodiment.

FIG. 6 is a plan view illustrating the ground conductor 6 including an H-shaped slot 5A. The rectangular slot 5 has been described; however, the H-shaped slot 5A may be formed in the ground conductor 6 instead of the slot 5 as illustrated in FIG. 6. Also in this case, the slot 5A is formed in the area covered with the one end of the waveguide 2 in the ground conductor 6, that is, the area surrounded by the opening edge b.

Next, the operation will be described.

For example, when a fundamental mode signal is input from the waveguide 2, the input signal is coupled to the slot 5 formed in the ground conductor 6. The signal coupled with the slot 5 is coupled with the conductor pattern 4. The electrical opening 4*a* is a loop pattern having a total perimeter length obtained by multiplying a half the guide wavelength by a natural number greater than or equal to 1 (in FIG. 2, a total perimeter length of three halves of the guide wavelength). For this reason, the signal coupled with the conductor pattern 4 is totally reflected by the electrical opening 4*a* and is propagated to the input/output terminal 4*b*.

Next, the effectiveness of the structure of converter 1 according to the first embodiment will be described.

Figure 7:
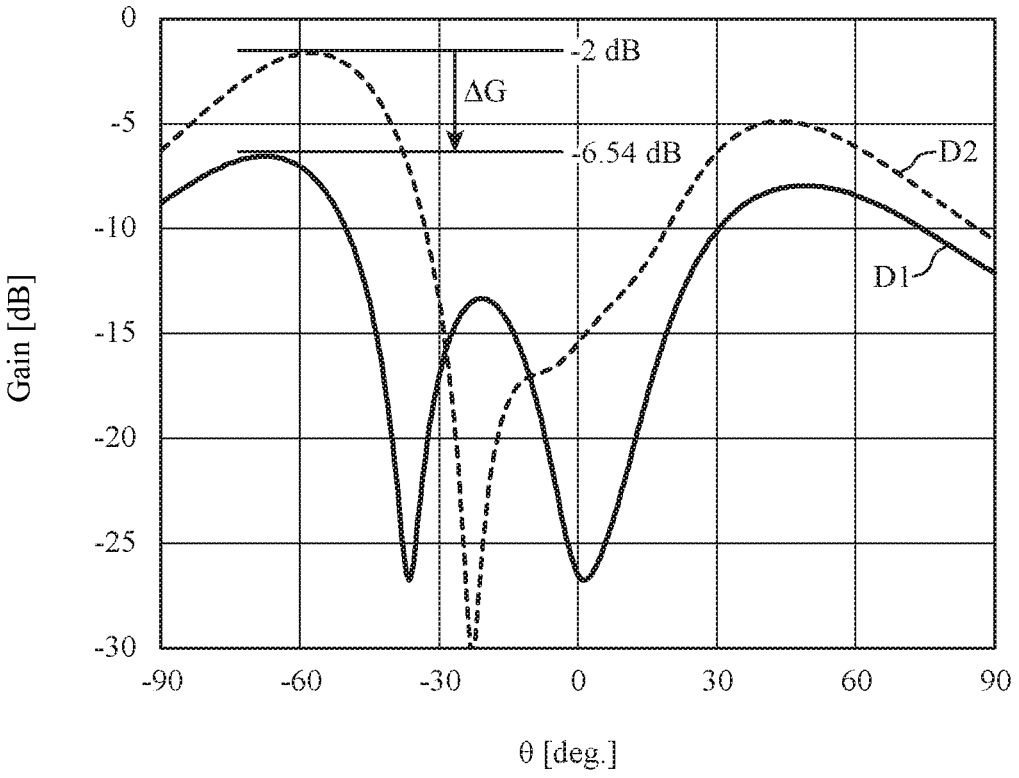
FIG. 7 is a graph illustrating an electromagnetic field analysis result of unwanted emission characteristics of the converter.

FIG. 7 is a graph illustrating electromagnetic field analysis results of unwanted emission characteristics of the converter 1 and a conventional converter. In FIG. 7, the horizontal axis represents the rotation angle θ from the z axis to the x axis around the y axis on the zx plane, and the vertical axis represents the emission amount (gain) of unwanted radio waves depending on the rotation angle D from the x axis to the y axis around the z axis on the xy plane. Illustrated in FIG. 7 is the emission amount of unwanted radio waves between θ=−90 (deg.) and +90 (deg.) at Φ=0 (deg.).

Data D1 indicated by a solid line indicates unwanted emission characteristics obtained by electromagnetic field analysis of the structure of the converter 1 illustrated in FIG. 1 and FIG. 2. Data D2 indicated by a broken line indicates unwanted emission characteristics obtained by electromagnetic field analysis of the structure of the conventional converter that does not include the electrical opening 4*a* nor the stubs 4*c* among the components of the converter 1. As illustrated in FIG. 7, in the conventional converter, the maximum emission amount of unwanted radio waves at Φ=0 (deg.) is −2 (dB) at θ=−60 (deg.). On the other hand, in the converter 1, the maximum emission amount of unwanted radio waves at Φ=0 (deg.) is −6.54 (dB) at θ=−60 (deg.). The emission amount of unwanted radio waves is improved by ΔG=4.54 (dB). Note that this effectiveness is similar to that of converters of a second embodiment and a third embodiment described later.

As described above, the converter 1 according to the first embodiment includes the electrical opening 4*a* which is a loop pattern, at one end of the conductor pattern 4 located immediately above one end of the waveguide 2, the dielectric substrate 3 being interposed between the one end of the conductor pattern 4 and the one end of the waveguide 2. Therefore, the converter 1 does not require the choke structure described in Patent Literature 1, and thus can be miniaturized. Since the electrical opening 4*a* is the loop pattern, it is possible to prevent leakage of radio waves even without a choke. As a result, the converter 1 can be miniaturized and suppress unwanted emission of radio waves.

In the converter 1 according to the first embodiment, the conductor pattern 4 is a belt-like pattern extending from the electrical opening 4*a* toward the input/output terminal 4*b*. The belt-like pattern has multiple pattern widths that each have a different characteristic impedance. This allows the impedance in the belt-like pattern to be matched, thereby mitigating the power loss.

In the converter 1 according to the first embodiment, the electrical opening 4*a* is a loop pattern having a total perimeter length obtained by multiplying a half wavelength of the guide wavelength by a natural number greater than or equal to 1. For example, the electrical opening 4*a* is an equilateral triangular loop pattern whose sides each have a length of a half wavelength of the guide wavelength, and is a loop pattern having the same pattern width or a loop pattern having partially different pattern widths. Since there is no opening at the end of the electrical opening 4*a*, it is possible to suppress emission of unwanted radio waves. In addition, since the choke having a length that is an odd multiple of a quarter wavelength of the guide wavelength is not required, the converter 1 can be miniaturized.

Second Embodiment

Figure 8:
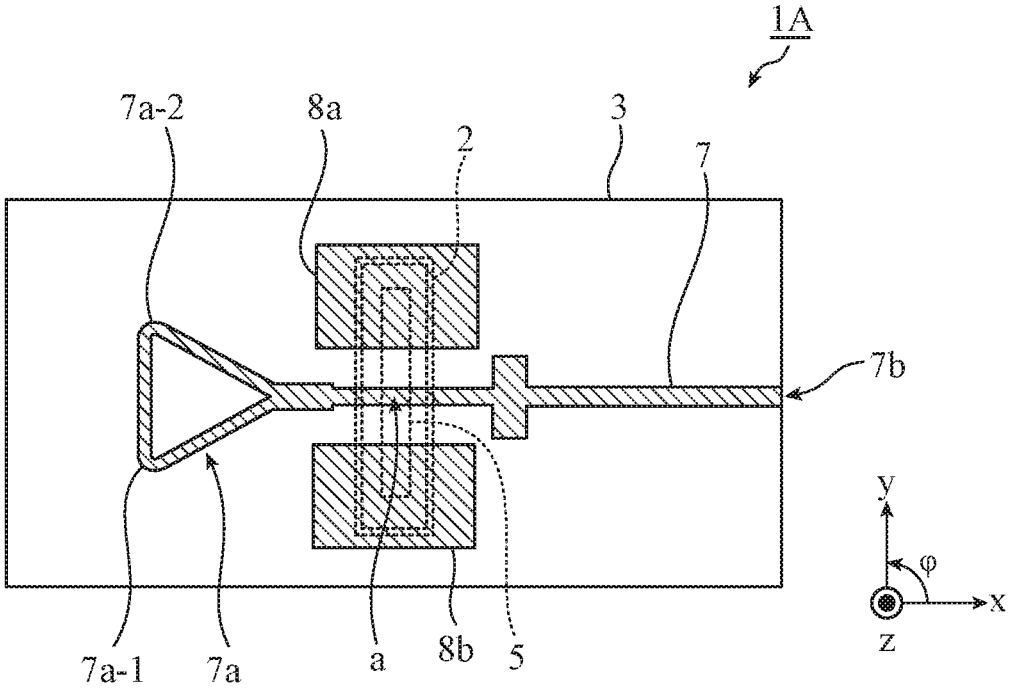
FIG. 8 is a top view illustrating a configuration of a converter according to a second embodiment of the invention.
Figure 9:
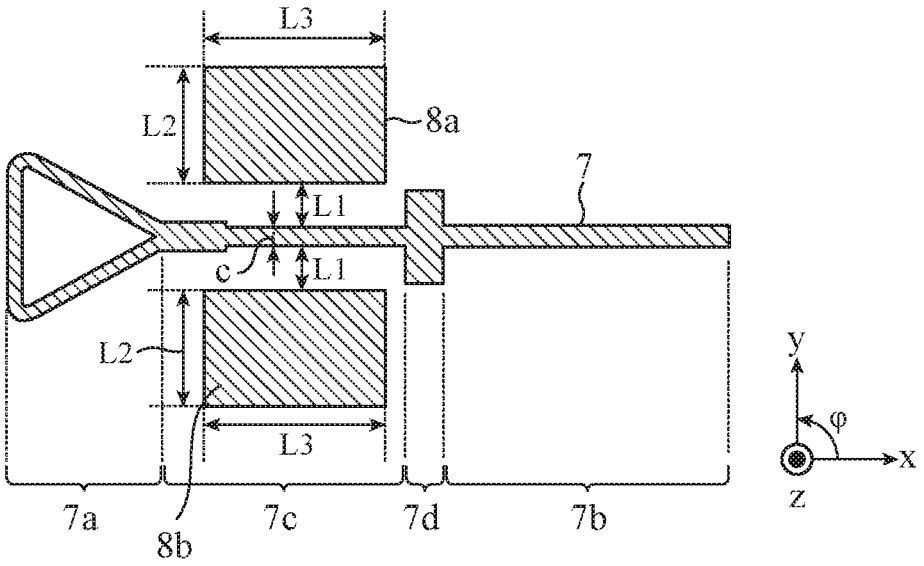
FIG. 9 is a plan view illustrating the front of the converter according to the second embodiment.

FIG. 8 is a top view illustrating a configuration of a converter 1A according to a second embodiment of the invention. FIG. 9 is a plan view illustrating the front of the converter 1A according to the second embodiment. The converter 1A performs conversion between a signal propagated in a waveguide 2 and a signal propagated in a planar circuit including a conductor pattern 7. As illustrated in FIG. 8 and FIG. 9, the converter 1A includes the waveguide 2, a dielectric substrate 3, a slot 5, the conductor pattern 7, a floating conductor 8*a*, and a floating conductor 8*b*, and a ground conductor 6 is provided on the back surface of the dielectric substrate 3 like in FIG. 2. As illustrated in FIG. 8, a position a is immediately above the center of an opening of the waveguide 2 with the dielectric substrate 3 interposed therebetween. As illustrated in FIG. 9, c denotes the pattern width of a conversion portion 7*c*. The floating conductor 8*a* and the floating conductor 8*b* are rectangular conductor patterns each having a length of L2 in the y axis direction and a length of L3 in the x axis direction.

The conductor pattern 7 includes the conversion portion 7*c* and an impedance transforming portion 7*d* in addition to an electrical opening 7*a* and an input/output terminal 7*b*. Parts of the floating conductor 8*a* and the floating conductor 8*b* are located immediately above one end of the waveguide 2 with the dielectric substrate 3 interposed therebetween, and are also located immediately above the slot 5 with the dielectric substrate 3 interposed therebetween. Each of the floating conductor 8*a* and the floating conductor 8*b* is separated from the conversion portion 7*c* by a distance L1 as illustrated in FIG. 9. The floating conductor 8*a* and the floating conductor 8*b* are in a positional relationship symmetric with respect to the x axis passing through the position a. Moreover, L3 is longer than L2, and L2 is longer than L1.

The electrical opening 7*a* is a loop pattern having a total perimeter length obtained by multiplying a half wavelength of the guide wavelength by a natural number greater than or equal to 1. In addition, since the electrical opening 7*a* is a loop pattern and there is no opening at the end, it is possible to suppress emission of unwanted radio waves. By providing the electrical opening 7*a*, a choke having a pattern width that is an odd multiple of a quarter wavelength of the guide wavelength described in Patent Literature 1 is unnecessary. For this reason, the converter 1A can be miniaturized as compared with converters of the related art.

In FIG. 8 and FIG. 9, the electrical opening 7*a* is an equilateral triangular loop pattern having a bended portion 7*a*-1 and a bended portion 7*a*-2. In this triangle, one side has a length of a half wavelength of the guide wavelength, and the total perimeter has a length of three halves of the guide wavelength. The bended portion 7*a*-1 and the bended portion 7*a*-2 are formed by bending the conductor pattern at positions each having a length of a half wavelength of the guide wavelength. As a result, each of the bended portion 7*a*-1 and the bended portion 7*a*-2 is a node of the electric field and in principle has no energy, and thus unwanted emission of radio waves is unlikely to occur.

Note that the electrical opening 7*a* which is a triangular loop pattern is merely an example, and may be a polygonal loop pattern of any polygon having four or more sides or a smooth curved loop pattern.

Although a pattern in which a part of the pattern width of the electrical opening 7*a* is tapered has been illustrated as an example, the pattern width of the electrical opening 7*a* may be set in any manner.

In the converter 1 according to the first embodiment, the position of the electrical opening 4*a* is away from the position a immediately above the waveguide 2 with the dielectric substrate 3 interposed therebetween, by 0 times a half wavelength of the guide wavelength. Meanwhile, in the converter 1A according to the second embodiment, the electrical opening 7*a* is formed at a position away from the position a immediately above the waveguide 2 with the dielectric substrate 3 interposed therebetween by a half wavelength of the guide wavelength.

In the converter 1 according to the first embodiment, the stubs 4*c* and the impedance transforming portions 4*e* to 4*g* adjust the characteristic impedance $Z_{4d}$ of the conversion portion 4*d* and the characteristic impedance $Z_{4b}$ of the input/output terminal 4*b*. In contrast, in the converter 1A according to the second embodiment, the impedance transforming portion 7*d*, the floating conductor 8*a*, and the floating conductor 8*b* adjust the characteristic impedance of the conversion portion 7*c* and the characteristic impedance of the input/output terminal 7*b*.

Since each of the floating conductor 8*a* and the floating conductor 8*b* is separated from the conversion portion 7*c* by a distance L1, a parasitic capacitance or a parasitic inductor component is added in the conversion portion 7*c*. This makes it possible to mitigate a rapid change in the impedance between the conversion portion 7*c* and the input/output terminal 7*b*, thereby allowing the converter 1A to effectively reduce the power loss.

Note that the converter 1A according to the second embodiment can mitigate a rapid change in the impedance between the conversion portion 7*c* and the input/output terminal 7*b*, and thus can handle a broadband signal.

The shape of the floating conductors 8*a* and 8*b* illustrated in FIG. 8 and FIG. 9 is one example, and may be a polygonal shape of any polygon having five or more sides or a smooth curved shape.

As described above, the converter 1A according to the second embodiment includes the floating conductor 8*a* and the floating conductor 8*b* provided on the front surface of the dielectric substrate 3. A part of each of the floating conductor 8*a* and the floating conductor 8*b* is located immediately above one end of the waveguide 2 with the dielectric substrate 3 interposed therebetween. With this configuration, effects similar to those of the first embodiment can be obtained. Moreover, since a sudden change in the impedance between the conversion portion 7*c* and the input/output terminal 7*b* in the conductor pattern 7 is mitigated, it is possible to handle a broadband signal.

Third Embodiment

Figure 10:
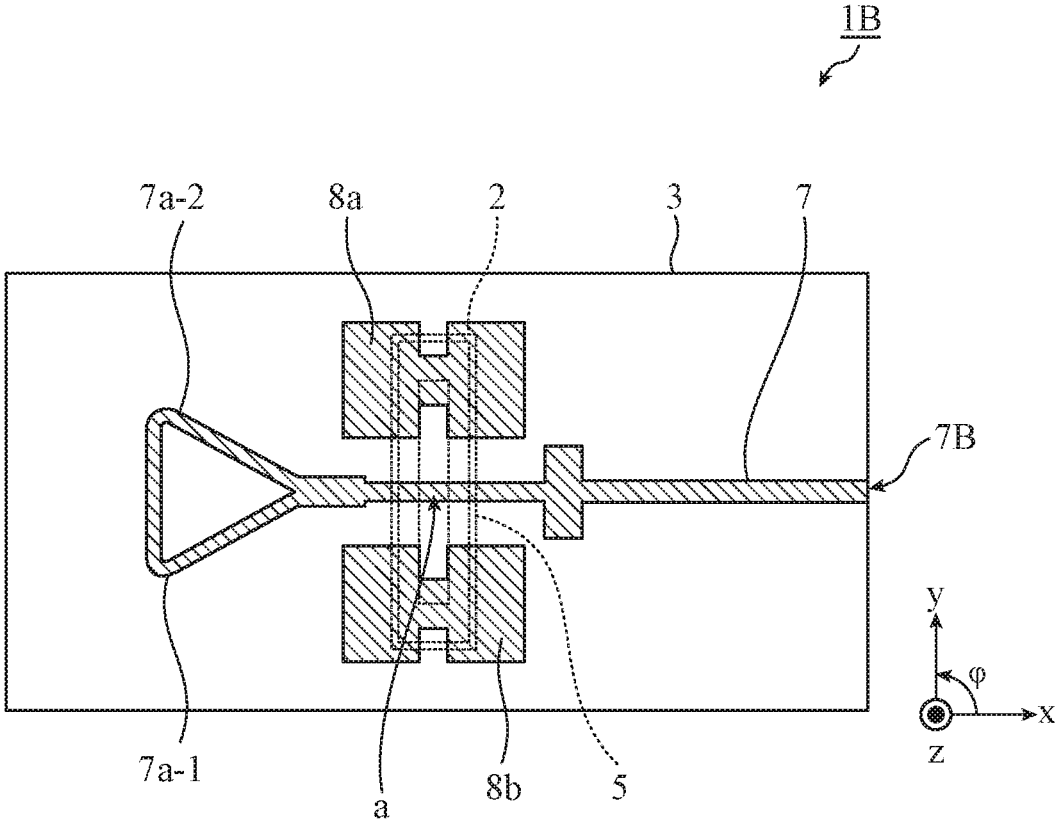
FIG. 10 is a top view illustrating a configuration of a converter according to a third embodiment of the invention.
Figure 11:
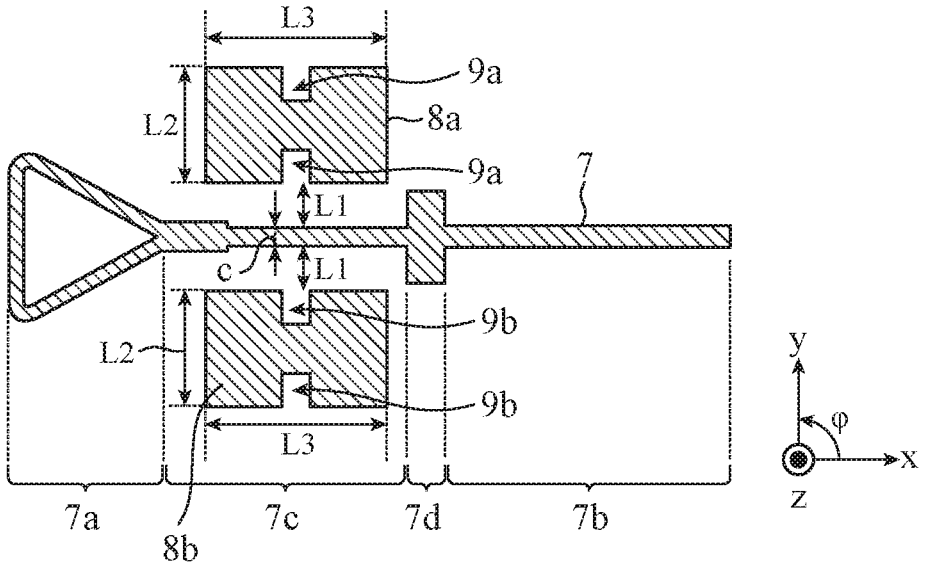
FIG. 11 is a plan view illustrating the front of the converter according to the third embodiment.

FIG. 10 is a top view illustrating a configuration of a converter 1B according to a third embodiment of the invention. FIG. 11 is a plan view illustrating the front of the converter 1B according to the third embodiment. The converter 1B performs conversion between a signal propagated in a waveguide 2 and a signal propagated in a planar circuit including a conductor pattern 7. As illustrated in FIG. 10 and FIG. 11, the converter 1B includes the waveguide 2, a dielectric substrate 3, a slot 5, the conductor pattern 7, a floating conductor 8*a*, and a floating conductor 8*b*, and a ground conductor 6 is provided on the back surface of the dielectric substrate 3 like in the converter 1 illustrated in FIG. 2. As illustrated in FIG. 10, a position a is immediately above the center of an opening of the waveguide 2 with the dielectric substrate 3 interposed therebetween. In FIG. 11, c denotes the pattern width of a conversion portion 7*c*. The floating conductor 8*a* and the floating conductor 8*b* are rectangular conductor patterns each having a length of L2 in the y axis direction and a length of L3 in the x axis direction.

In the converter 1A according to the second embodiment, as illustrated in FIG. 9, the floating conductor 8*a* and the floating conductor 8*b* are rectangular conductor patterns each having a length of L2 in the y axis direction and a length of L3 in the x axis direction. In contrast, the floating conductor 8*a* and the floating conductor 8*b* included in the converter 1B according to the third embodiment include rectangular cutout portions 9*a* and cutout portions 9*b* at parts thereof as illustrated in FIG. 11. Each of the two cutout portions 9*a* and the two cutout portions 9*b* is disposed on the same straight line along the longitudinal direction (y axis direction) of the slot 5 with the dielectric substrate 3 interposed therebetween.

The conductor pattern 7 includes the conversion portion 7*c* and an impedance transforming portion 7*d* in addition to an electrical opening 7*a* and an input/output terminal 7*b*. Parts of the floating conductor 8*a* and the floating conductor 8*b* are located immediately above one end of the waveguide 2 with the dielectric substrate 3 interposed therebetween, and are also located immediately above the slot 5 with the dielectric substrate 3 interposed therebetween. Each of the floating conductor 8*a* and the floating conductor 8*b* is separated from the conversion portion 7*c* by a distance L1 as illustrated in FIG. 11. The floating conductor 8*a* and the floating conductor 8*b* are in a positional relationship symmetric with respect to the x axis passing through the position a. Moreover, L3 is longer than L2, and L2 is longer than L1.

The electrical opening 7*a* is a loop pattern having a total perimeter length obtained by multiplying a half wavelength of the guide wavelength by a natural number greater than or equal to 1. In addition, since the electrical opening 7*a* is a loop pattern and there is no opening at the end, it is possible to suppress emission of unwanted radio waves. By providing the electrical opening 7*a*, a choke having a pattern width that is an odd multiple of a quarter wavelength of the guide wavelength described in Patent Literature 1 is unnecessary. For this reason, the converter 1A can be miniaturized as compared with converters of the related art.

In FIG. 10 and FIG. 11, the electrical opening 7*a* is an equilateral triangular loop pattern having a bended portion 7*a*-1 and a bended portion 7*a*-2. In this triangle, one side has a length of a half wavelength of the guide wavelength, and the total perimeter has a length of three halves of the guide wavelength. The bended portion 7*a*-1 and the bended portion 7*a*-2 are formed by bending the conductor pattern at positions each having a length of a half wavelength of the guide wavelength. As a result, each of the bended portion 7*a*-1 and the bended portion 7*a*-2 is a node of the electric field and in principle has no energy, and thus unwanted emission of radio waves is unlikely to occur.

Note that although the structure in which the electrical opening 7*a* is a triangular loop pattern has been illustrated; however, this is an example, and the electrical opening 7*a* may be a polygonal loop pattern of any polygon having four or more sides or a smooth curved loop pattern. Furthermore, although a pattern in which a part of the pattern width of the electrical opening 7*a* is tapered has been illustrated as an example, the pattern width of the electrical opening 7*a* may be set in any manner.

In the converter 1 according to the first embodiment, the position of the electrical opening 4*a* is away from the position a immediately above the waveguide 2 with the dielectric substrate 3 interposed therebetween, by 0 times a half wavelength of the guide wavelength. Meanwhile, in the converter 1B according to the third embodiment, the electrical opening 7*a* is formed at a position away from the position a immediately above the waveguide 2 with the dielectric substrate 3 interposed therebetween by a half wavelength of the guide wavelength.

In the converter 1 according to the first embodiment, the stubs 4*c* and the impedance transforming portions 4*e* to 4*g* adjust the characteristic impedance $Z_{4d}$ of the conversion portion 4*d* and the characteristic impedance $Z_{4b}$ of the input/output terminal 4*b*. In contrast, in the converter 1B according to the third embodiment, the impedance transforming portion 7*d*, the floating conductor 8*a*, and the floating conductor 8*b* adjust the characteristic impedance of the conversion portion 7*c* and the characteristic impedance of the input/output terminal 7*b*.

Each of the cutout portions 9*a* included in the floating conductor 8*a* and the cutout portions 9*b* included in the floating conductor 8*b* is disposed at a position where the electric field is a node on the corresponding floating conductor. With the cutout portions 9*a* and the cutout portions 9*b*, the current that has been widely distributed around the ends of the floating conductor 8*a* and the floating conductor 8*b* is concentrated at the cutout portions 9*a* and the cutout portions 9*b*. Since a current flows in opposite directions along the two sides in the y axis direction in each of the rectangular cutout portions 9*a* and cutout portions 9*b*, and the distance between the two sides is short than the wavelength, most of the emission caused by the current is canceled out. Moreover, the current flowing along one side in the x axis direction of each of the rectangular cutout portions 9*a* and cutout portions 9*b* is not efficiently emitted to the space, because the one side is shorter than the wavelength. Based on the above principles, the cutout portions 9*a* and the cutout portions 9*b* included in the floating conductor 8*a* and the floating conductor 8*b* can suppress unwanted emission.

Figure 12:
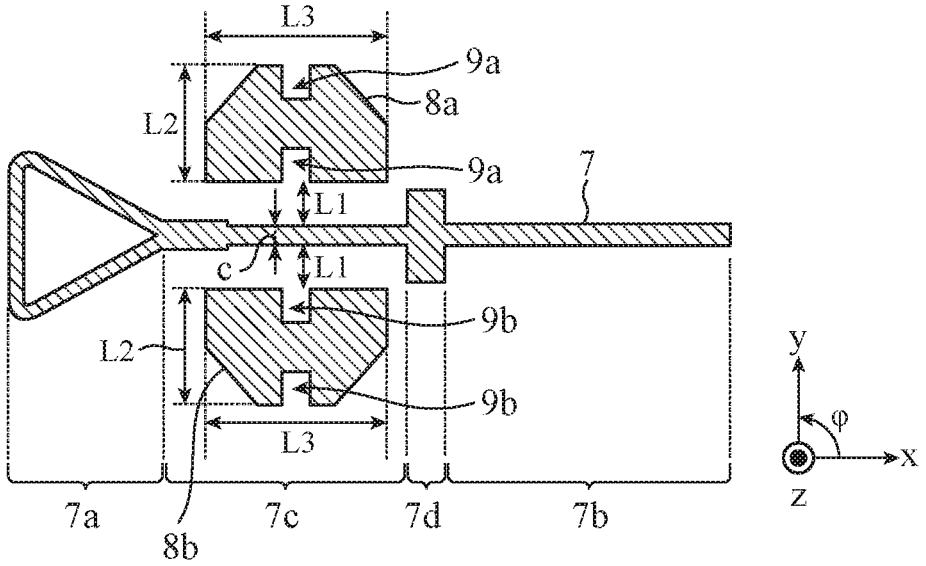
FIG. 12 is a plan view illustrating the front of a modification of the converter according to the third embodiment.
Figure 13:
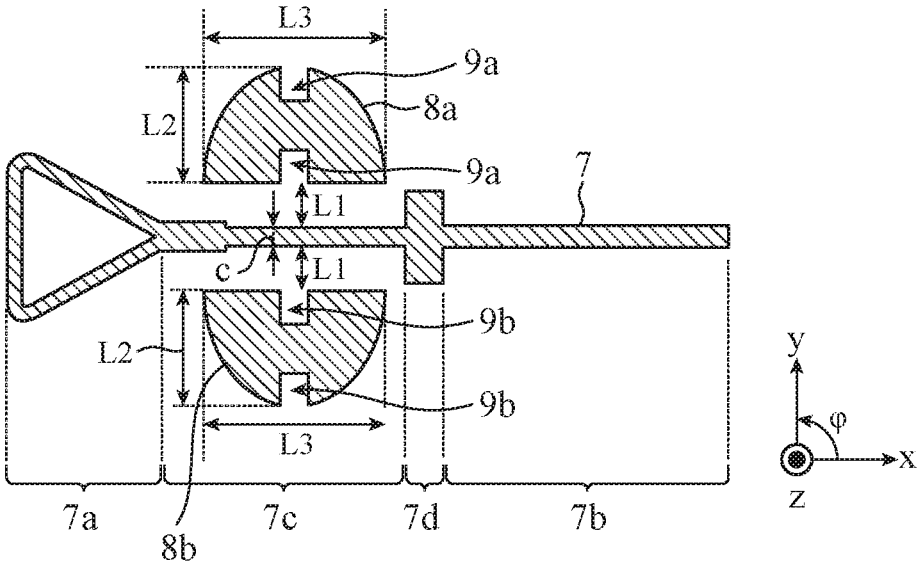
FIG. 13 is a plan view illustrating the front of another modification of the converter according to the third embodiment.

The shape of the floating conductor 8*a* and the floating conductor 8*b* illustrated in FIG. 10 and FIG. 11 is one example of a floating conductor in which rectangular cutouts are included in parts of the rectangular conductor. FIG. 12 and FIG. 13 are plan views each illustrating the front of a modification of the converter 1B according to the third embodiment. The floating conductor 8*a* and the floating conductor 8*b* may have a polygonal shape of a polygon having five or more sides as illustrated in FIG. 12, or may have a shape partially having a smoothly curved contour as illustrated in FIG. 13. Furthermore, the shape of the cutout portions 9*a* and the cutout portions 9*b* illustrated in FIG. 10 to FIG. 13 is also one example, and may have a shape of a polygon having three or more sides or a shape having a smoothly curved contour.

Next, the effectiveness of the structure of converter 1B according to the third embodiment will be described.

Figure 14:
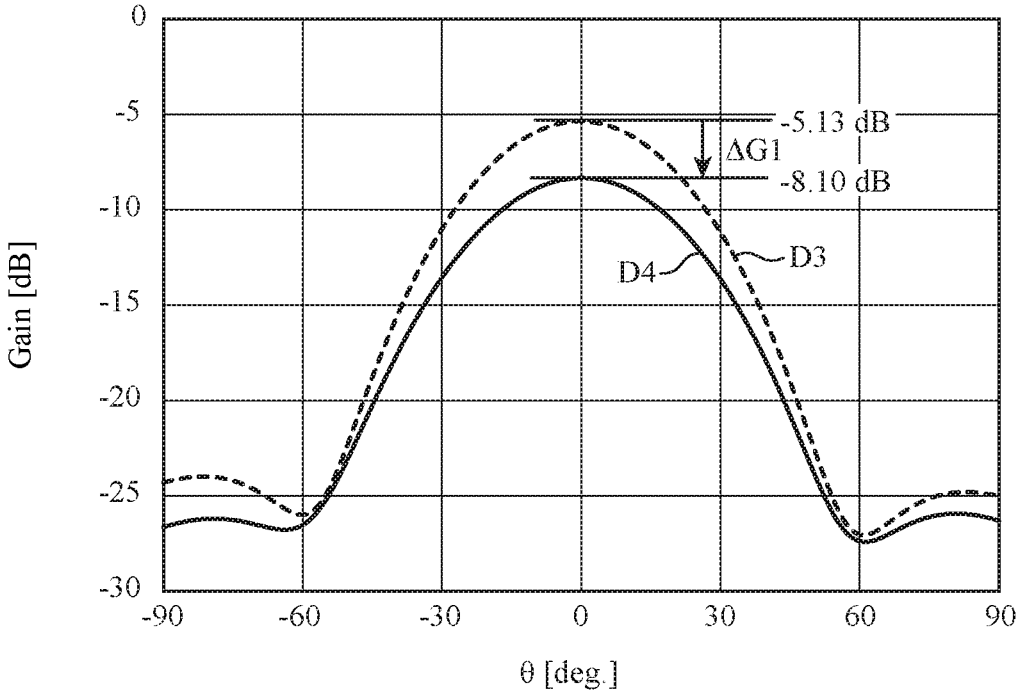
FIG. 14 is a graph illustrating electromagnetic field analysis results of unwanted emission characteristics of the converter according to the second embodiment and the converter according to the third embodiment.

FIG. 14 is a graph illustrating electromagnetic field analysis results of unwanted emission characteristics of the converter 1A according to the second embodiment and the converter 1B according to the third embodiment. In FIG. 14, the horizontal axis represents the rotation angle θ from the z axis to the x axis around the y axis on the zx plane, and the vertical axis represents the emission amount (gain) of unwanted radio waves depending on the rotation angle D from the x axis to the y axis around the z axis on the xy plane. Illustrated in FIG. 14 is the emission amount of unwanted radio waves between θ=−90 (deg.) and +90 (deg.) at Φ=0 (deg.).

In FIG. 14, data D4 indicated by a solid line indicates unwanted emission characteristics obtained by electromagnetic field analysis of the structure of the converter 1B illustrated in FIG. 10 and FIG. 11. Data D3 indicated by a broken line indicates unwanted emission characteristics obtained by electromagnetic field analysis of the structure of the converter 1A illustrated in FIG. 8 and FIG. 9. In the converter 1A, the maximum emission amount of unwanted radio waves at Φ=0 (deg.) is −5.13 (dB) at θ=0 (deg.). On the other hand, in the converter 1B, the maximum emission amount of unwanted radio waves at Φ=0 (deg.) is −8.10 (dB) at θ=0 (deg.). The emission amount of unwanted radio waves is improved by ΔG1=2.97 (dB) in the converter 1B.

As described above, the converter 1B according to the third embodiment includes the rectangular cutout portions 9*a* and cutout portions 9*b* provided in respective parts of the floating conductor 8*a* and the floating conductor 8*b* provided on the front surface of the dielectric substrate 3. The cutout portions 9*a* and the cutout portions 9*b* are arranged on the same straight line along the longitudinal direction (y axis direction) of the slot 5 with the dielectric substrate 3 interposed therebetween. With this configuration, similar effects to those of the first embodiment can be obtained, and emission from the floating conductor 8*a* and the floating conductor 8*b* can be further reduced.

The converter 1 according to the first embodiment, the converter 1A according to the second embodiment, and the converter 1B according to the third embodiment may be mounted on an antenna device. In this case, since each of the converter 1, the converter 1A, and the converter 1B can be miniaturized, it is also possible miniaturize an antenna device including any of those.

Note that the present invention is not limited to the above embodiments, and the present invention may include a flexible combination of the individual embodiments, a modification of any component of the individual embodiments, or omission of any component in the individual embodiments within the scope of the present invention.

INDUSTRIAL APPLICABILITY

A converter according to the present invention is miniaturized and can suppress unwanted emission of radio waves, and thus can be used, for example, in an in-vehicle antenna device.

REFERENCE SIGNS LIST

1, 1A, 1B: converter, 2: waveguide, 3: dielectric substrate, 4, 7: conductor pattern, 4*a*, 7*a*: electrical opening, 4*a*-1, 4*a*-2, 7*a*-1, 7*a*-2: bended portion, 4*b*, 7*b*: input/output terminal, 4*c*: stub, 4*d*, 7*c*: conversion portion, 4*e* to 4*g*, 7*d*: impedance transforming portion, 5, 5A: slot, 6: ground conductor, 8*a*, 8*b*: floating conductor, 9*a*, 9*b*: cutout portion

The invention claimed is:

1. A converter comprising:

a waveguide;

a dielectric substrate coupled with one end of the waveguide on a back surface of the dielectric substrate;

a conductor pattern provided on a front surface of the dielectric substrate and having a signal input/output terminal at one end of the conductor pattern and an electrical opening that is electrically open at another end of the conductor pattern;

a ground conductor provided on the back surface of the dielectric substrate; and one or more slots formed in an area covered with the one end of the waveguide in the ground conductor, wherein a part of the conductor pattern is located immediately above the one end of the waveguide, the dielectric substrate being interposed between the part of the conductor pattern and the one end of the waveguide, and the electrical opening is a loop pattern.

2. The converter according to claim 1, wherein the conductor pattern is a belt-like pattern extending from the electrical opening toward the input/output terminal, and the belt-like pattern has multiple pattern widths each having a different characteristic impedance.

3. The converter according to claim 1, further comprising:

at least one floating conductor provided on the front surface of the dielectric substrate, wherein a part of the floating conductor is located immediately above the one end of the waveguide, the dielectric substrate being interposed between the part of the floating conductor and the one end of the waveguide.

4. The converter according to claim 3, wherein the floating conductor is a rectangular pattern or a polygonal pattern.

5. The converter according to claim 3, wherein the floating conductor includes at least one or more cutout portions, and the cutout portions are arranged on a straight line along a longitudinal direction of the slot, the dielectric substrate being interposed between the cutout portions and the slot.

6. The converter according to claim 1, wherein the conductor pattern forms one of a microstrip-line, a stripline, a coplanar line, and a coplanar line having the ground conductor.

7. The converter according to claim 1, wherein the electrical opening is positioned away from a position immediately above the one end of the waveguide, the dielectric substrate being interposed between the position and the one end of the waveguide, toward a side opposite to the input/output terminal by 0 times or an integral multiple greater than or equal to 1 of a half wavelength of a guide wavelength.

8. The converter according to claim 1, wherein the electrical opening is a loop pattern having a total perimeter length obtained by multiplying a half wavelength of a guide wavelength by a natural number greater than or equal to 1.

9. The converter according to claim 1, wherein the electrical opening is a triangular loop pattern whose at least one side has a length of a half wavelength of a guide wavelength.

10. The converter according to claim 1, wherein the electrical opening is a loop pattern having a same pattern width or a loop pattern partially having different pattern widths.

11. The converter according to claim 1, wherein the slot has a rectangular shape or is H-shaped.

12. The converter according to claim 1, wherein the dielectric substrate is a multilayer dielectric substrate including a plurality of substrates.

13. The converter according to claim 1, wherein the waveguide is a hollow waveguide having a metal tube wall.

14. The converter according to claim 1, wherein the waveguide has a metal tube wall and is partially filled with a dielectric, or has a tube wall in which a plurality of through-holes is formed and is partially filled with a dielectric.

15. An antenna device comprising the converter according to claim 1.

* * * * *